US006751325B1

(12) United States Patent
Fischer

(10) Patent No.: US 6,751,325 B1
(45) Date of Patent: Jun. 15, 2004

(54) HEARING AID AND METHOD FOR PROCESSING MICROPHONE SIGNALS IN A HEARING AID

(75) Inventor: Eghart Fischer, Schwabach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 09/806,374

(22) PCT Filed: Sep. 17, 1999

(86) PCT No.: PCT/EP99/06916

§ 371 (c)(1),
(2), (4) Date: May 29, 2001

(87) PCT Pub. No.: WO00/19770

PCT Pub. Date: Apr. 6, 2000

(30) Foreign Application Priority Data

Sep. 29, 1998 (DE) ..... 198 44 761

(51) Int. Cl.[7] ..... H04R 25/00

(52) U.S. Cl. ..... 381/313; 381/317; 381/71.12; 381/321

(58) Field of Search ..... 381/57, 58, 71.11, 381/71.12, 91, 92, 98, 102, 103, 104, 107, 109, 111, 112, 122, 312, 313, 318, 320, 321, 356, 357, 358, FOR 128, FOR 130, FOR 142

(56) References Cited

U.S. PATENT DOCUMENTS 4,751,738 A 6/1988 Widrow et al.
4,956,867 A * 9/1990 Zurek et al. ..... 381/94.7
5,568,558 A * 10/1996 Ramm et al. ..... 381/94.4

FOREIGN PATENT DOCUMENTS

| | | | |
|---|---|---|---|
| CH | EP0802699 A2 * | 7/1997 | ..... H04R/1/00 |
| DE | OS 32 04 567 | 8/1982 | |
| DE | OS 35 12 999 | 10/1985 | |
| DE | OS 40 26 420 | 2/1991 | |
| DE | PS 43 27 901 | 2/1995 | |
| EP | 0 499 699 | 11/1991 | |
| EP | 0 466 676 | 1/1992 | |
| EP | 0 579 152 | 1/1994 | |
| EP | 0 802 699 | 10/1997 | |
| EP | 0 848 573 | 6/1998 | |
| WO | WO 94/24834 | 10/1994 | |

* cited by examiner

*Primary Examiner*—Curtis Kuntz
*Assistant Examiner*—Brian Ensey
(74) *Attorney, Agent, or Firm*—Schiff Hardin LLP

(57) ABSTRACT

In a hearing aid and a method for processing microphone signals in a hearing aid, a signal processing unit is provided in order to amplify and/or attenuate signal parts of at least two microphone signals in a directionally dependent manner. The hearing aid has a signal analysis unit that is capable of modifying at least one property of the direction-dependent amplification and/or attenuation thereby achieving high transmission quality and noise suppression in a multitude of auditory situations.

14 Claims, 2 Drawing Sheets

HEARING AID AND METHOD FOR PROCESSING MICROPHONE SIGNALS IN A HEARING AID

FIELD OF THE INVENTION

The invention is directed to a hearing aid of the type having a microphone unit with at least two microphones for generating at least two microphone signals, and a signal processing unit supplied with the microphone signals which generates an output signal therefrom, wherein signal components of the microphone signals are amplified and/or attenuated in a directionally dependent manner, and a reproduction unit connected to the signal processing unit from which the output signal is emitted. The invention is provided for use in all types of hearing aids, however, the invention is especially suited for highly developed hearing aids that, for example, have digital signaling processing components.

DESCRIPTION OF THE PRIOR ART

European Application 802699 discloses a method for electronically increasing of the spacing between two acousto-electrical transducers as well as the application of this method in a hearing aid. The phase shift between the signals registered by the acousto-electrical transducers is thereby first identified. Subsequently, at least one of the signals is supplied to a phase shifter.

A hearing aid of the above general type is disclosed in German Patentschrift 43 27 901. Here, a signal processing unit serves the purpose of achieving a predetermined directional characteristic on the basis of a suitable mixing of signals of a plurality of microphones. The properties of this directional effect, however, are permanently prescribed. Signal components from lateral signal sources are always attenuated and signal parts from signal sources arranged in front of or behind the hearing aid user are amplified.

Given this hearing aid, therefore, little flexibility is established in the case of changing auditory situations. Noises from signal sources behind the hearing aid user are not attenuated. The attenuation mechanism, which also necessarily deteriorates the wanted sound reproduction, is constantly active. The reproduction quality of the hearing aid is therefore not optimum when no unwanted noise attenuation is required in an auditory situation.

SUMMARY OF THE INVENTION

An object of the invention, accordingly, is to avoid the aforementioned problems and offer a hearing aid as well as a method for processing microphone signals in a hearing aid having high transmission quality and noise suppression in numerous auditory situations.

The above object is achieved in a hearing aid, and in a method for processing signals in a hearing aid, of the type of initially described, wherein a signal analysis unit is employed for undertaking a directional analysis of the microphone signals, and wherein the signal processing unit of the microphone signals, and wherein the signal processing unit modifies at least one property of the directionally dependent amplification and/or attenuation dependent on the directional analysis made by the signal analysis unit.

The invention proceeds on the basis of the idea of varying the properties of an existing directionally dependent amplification/attenuation according to the result of an additional signal analysis. Thus, an especially good adaptation of the inventive hearing aid to different auditory situations can be realized. For example, the direction of a noise source can be taken into consideration in the directionally dependent amplification/attenuation in order to offer good noise elimination. When no noteworthy unwanted sound is present, in contrast, the noise attenuation can be switched off in order to minimize distortions.

The modification of a property of the directionally dependent amplification/attenuation assumes a directional dependency of the amplification/attenuation that exists without this modification.

In preferred embodiments of the invention, the intensities of signal parts of the microphone signals in a number of predetermined direction classes (angular ranges) are defined in the direction analysis. As a result, the approximate direction of the principal component of a noise source can be identified. Alternatively, the direction of one or more signal sources can be determined more precisely.

An adaptive LMS filter can be employed for the signal analysis, signal distortions, in particular, being estimated therewith by whole multiples of a sampling cycle. The coefficients of the LMS filter determined by the adaption event can influence the result of the direction analysis or (completely) define it or even represent this result themselves.

Dependent on the result of the signal analysis, different signal processing steps can be implemented in preferred embodiments. For example, the directional characteristic of a directional microphone (a virtual directional microphone formed by superimposition of the microphone signals) can be suitably modified. Such a modification can, in particular, be an alignment of the directional microphone pole. Alternatively or additionally, a suitable noise elimination method can be selected.

Weighting signals, that determine the weighting factors with which the results of different filter, noise elimination and/or directional methods enter into the output signal, are preferably generated in the evaluation of the signal analysis.

The microphones for generating the microphone signals in preferred embodiments are arranged at a relatively slight distance of at most 5 cm or at most 2.5 cm or approximately 1.6 cm from one another, whereby the connecting line between the microphones can extend at an angle of at most 45° or at most 30° relative to the line of sight of the hearing aid user or can lie approximately in this line of sight. In particular, a common housing can be provided for both microphones.

DESCRIPTION OF THE PREFERRED EMBODIMENTS

Figure 1:
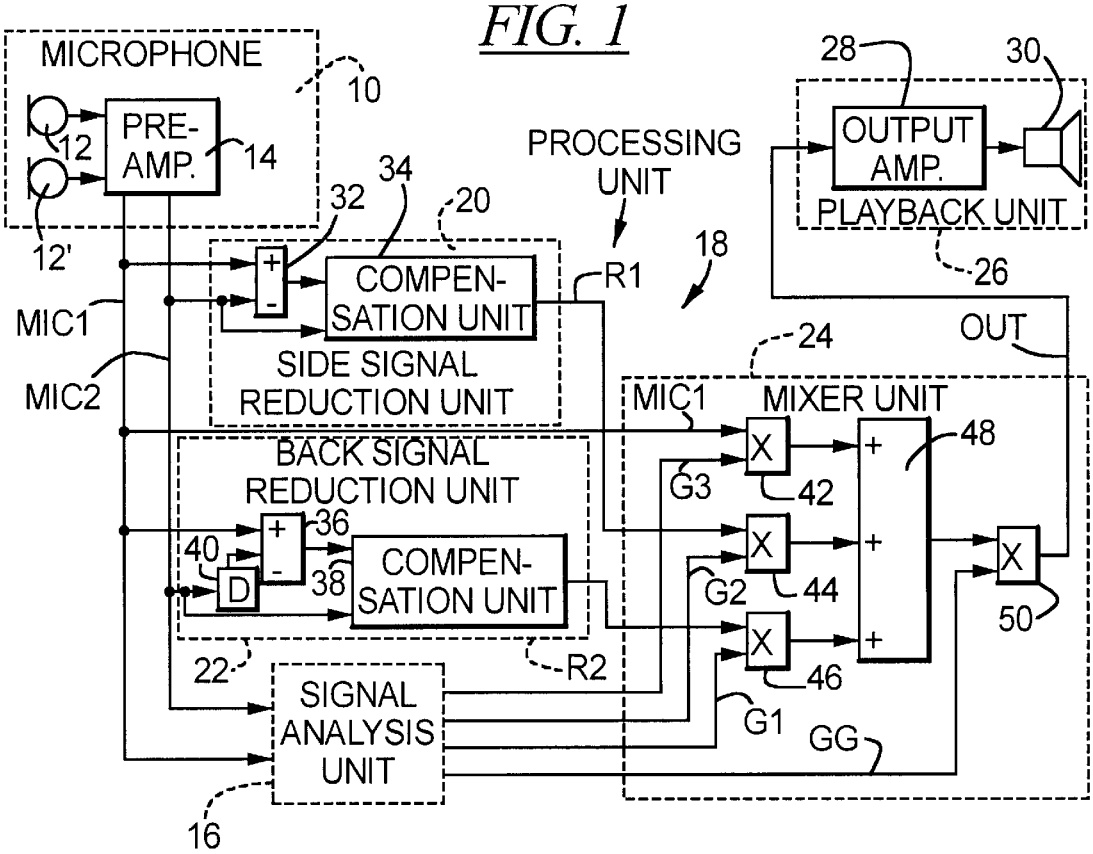
FIG. 1 is a block circuit diagram of a hearing aid constructed and operating in accordance with the present invention.

The hearing aid circuit shown in FIG. 1 has a known microphone unit 10 that contains two omni-directional microphones 12, 12' and a two-channel, distortion-correcting pre-amplifier 14. The two microphones 12, 12' are arranged at a spacing of approximately 1.6 cm. This distance roughly corresponds to the distance that sound covers during a sampling cycle of the hearing circuit. When the hearing aid is worn, the connecting line between the two microphones 12, 12' proceeds approximately in the line of sight of the hearing aid user, with the first microphone 12 located at the front and the second microphone 12' located at the back. The microphone unit 10 generates a first microphone signal MIC1 and a second microphone signal MIC2 that respectively derive from the first and from the second microphones 12, 12'.

The two microphone signals MIC1 and MIC2 are supplied to a signal analysis unit 16 and to a signal processing unit 18. The signal analysis unit 16 evaluates the microphone signals MIC1, MIC2 and generates three weighting signals G1, G2, G3 and an overall weighting signal GG therefrom. In the exemplary embodiment described here, the signal processing unit 18 is composed of a side signal reduction unit 20, a back signal reduction unit 22 and a mixer unit 24. An output signal OUT of the signal processing unit 18 is supplied to a reproduction unit 26 and is supplied thereat to a preferably electro-acoustic transducer 30, for example a loudspeaker, via an output amplifier 28.

The side signal reduction unit 20 receives the microphone signals MIC1, MIC2 and generates a first noise-reduced signal R1 therefrom wherein signal parts of the two microphone signals MIC1, MIC2 that derive from a sound source that is to the side of the hearing aid user are largely suppressed. To this end, the side signal reduction unit 20 has a subtractor 32 that forms the difference between the two microphone signals MIC1, MIC2. The difference signal and the second microphone signal MIC2 are conducted to a compensation unit 34 for producing the first noise-reduced signal R1.

In the simplest case, the compensation unit 34 merely forwards the difference signal obtained from the subtractor 32 as first noise-reduced signal R1, and the second microphone signal MIC2 is not taken into consideration. In alternative embodiments, the compensation unit 34 is fashioned as predictor in order to achieve a better attenuation effect for signal parts of side signal sources by suitable mixing of the difference signal and the second microphone signal MIC2. A side signal reduction unit 20 having such a compensation unit 34 is disclosed in the application of the same inventor bearing the title "Verfahren zum Bereitstellen einer Richtmikrofoncharakteristik und Hörgerät", the content thereof being herewith incorporated into the present application.

The back signal reduction unit 22, similar to the side signal reduction unit 20, has a subtractor 36 and a compensation unit 38 that generates a second noise-reduced signal R2. Those components of the microphone signals MIC1, MIC2 that derive from signal sources behind the hearing aid user are suppressed in the second noise-reduced signal R2. The positive input of the subtractor 36 is connected to the first microphone signal MIC1, whereas the negative input (to be subtracted) is connected to the microphone signal MIC2 via a delay unit 40 that effects a delay by one sampling cycle. Even taking the back signal reduction unit 22 into consideration, the compensation unit 38 in the simplest case can forward the different signal of the subtractor 36 unmodified as second to noise-reduced signal R2. Alternatively, the back signal reduction unit 22 can be provided with a compensation unit 38 fashioned as predictor as described in detail in the application cited in the preceding paragraph.

The mixing unit 24 has three weighting amplifiers 42, 44, 46, of which the first multiplies the first microphone signal MIC1 by the weighting signal G3, the second multiplies the first noise-reduced signal R1 by the weighting signal G2, and the third multiplies the second noise-reduced signal R2 by the weighting signal G1. The weighting signals G1, G2, G3 are thus employed as gain factors. The output signals of the weighting amplifiers 42, 44, 46 are added by a summer 48. The output signal of the summer 48 is multiplied by the overall weighting signal GG by a further weighting amplifier 50 in order to obtain the output signal OUT of the mixing unit 24 (and of the overall signal processing unit 18).

Figure 2:
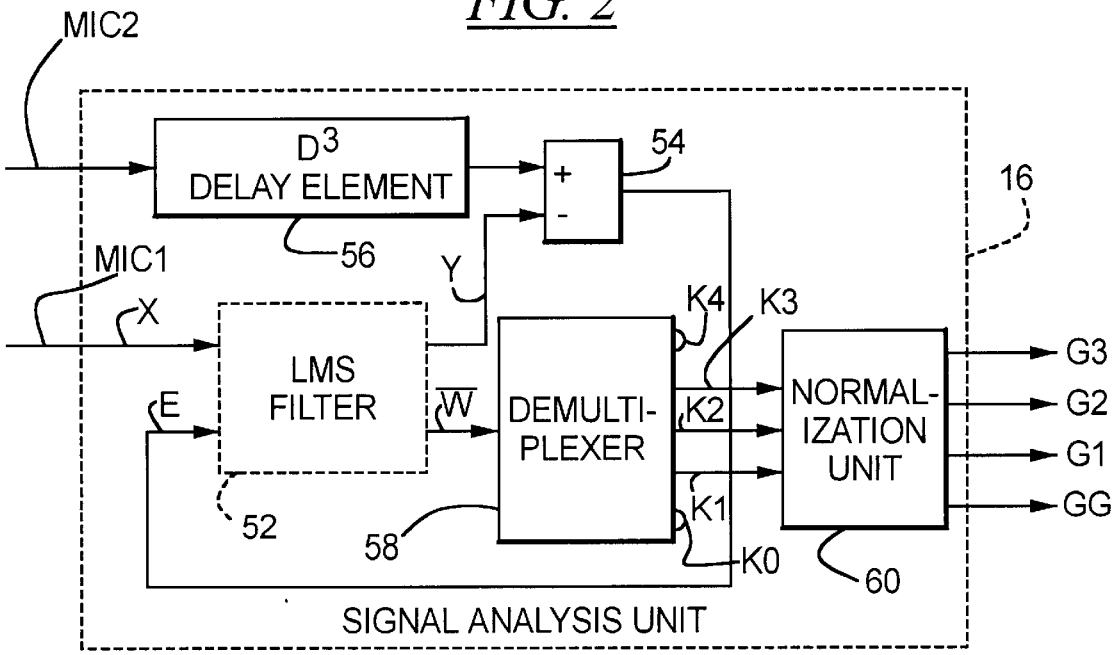
FIG. 2 is a block circuit diagram of a signal analysis unit in the circuit of FIG. 1.

The more precise structure of the signal analysis unit 16 is shown in FIG. 2. The first microphone signal MIC1 is supplied as input signal X to an LMS filter 52 (LMS=least mean square). The filtered output signal Y of the LMS filter 52 is connected to the negative input of a subtractor 54. The microphone signal MIC2 is supplied to the positive input of the subtractor 54 via a delay element 56 that offers a delay of three sampling cycles, and the difference signal formed by the subtractor 54 is supplied to the LMS filter 52 as error signal E. In formal notation, the following is thus valid for each sampling time t:

$$e(t)=mic2(t-3)-y(t), \tag{1}$$

whereby e(t) is the error value of the error signal E at time t, y(t) is the output value of the LMS filter 52 at time t and mic2 (t−3) is the value of the second microphone signal MIC2 at time t−3 (three time clocks receiving the time t).

A coefficient vector signal $\overline{W}$ of the LMS filter 52 is adjacent at a demultiplexer 58. The coefficient vector signal $\overline{W}$ transmits a coefficient vector $\overline{w}$ (t) for each sampling time t, this containing five values k0(t), k1(t), k2(t), k3(t), k4(t) for the filter coefficients (taps). Thus valid informal notation is:

$$\overline{W}(t)=(k0(t), k1(t), k2(t), k3(t), k4(t)). \tag{2}$$

The demultiplexer 58 determines five coefficient signals K0, K1, K2, K3, K4 from the coefficient vector signal $\overline{W}$, these indicating the value curve of the respectively corresponding coefficients. The three "middle" coefficient signals K1, K2, K3—as shall described in greater detail later—contain information about the spatial arrangement of the signal sources relative to the hearing aid user. This allocation of the filter coefficients is the result of the delay of the second microphone signal MIC2 by three time units as a result of the delay element 56. The transmission of the coefficient vectors and of the filter coefficients in the coefficient vector signal $\overline{W}$ ensues serially in the exemplary embodiment described here on the basis of suitable protocol to which the demultiplexer 58 is adapted. In modified embodiments, the coefficients are transmitted in some other way, particularly parallel or partially parallel and partially serially.

A norming unit 60 norms the three coefficient signals K1, K2, K3 and generates the weighting signals G1, G2, G3 as well as the overall weighting signal GG therefrom.

Figure 3:
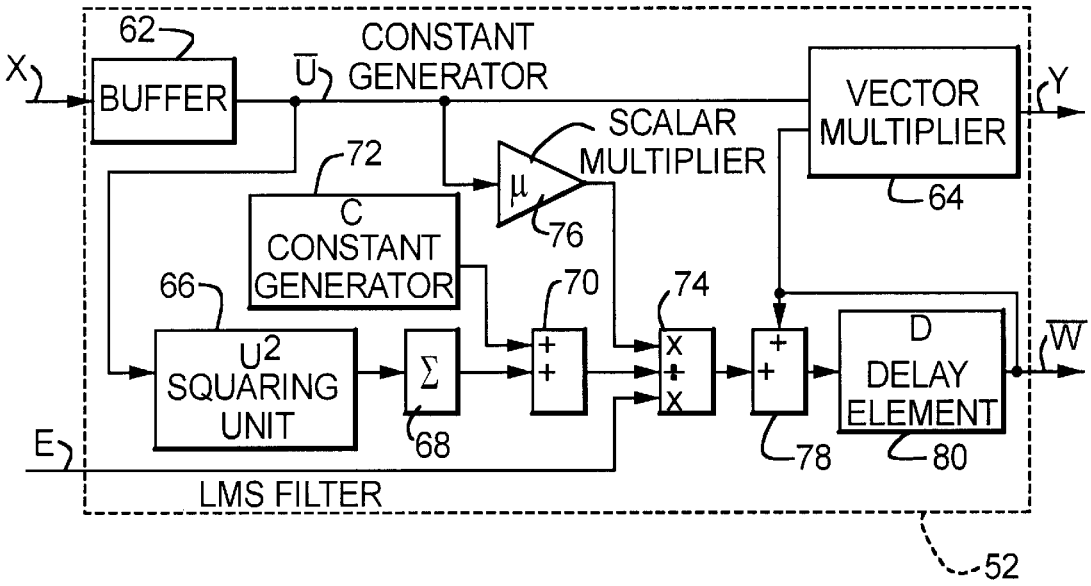
FIG. 3 is a block circuit diagram of an LMS filter in the circuit of FIG. 2.

FIG. 3 illustrates the internal structure of the LMS filter 52. The input signal X is adjacent at a buffer 62 that generates an input vector signal $\overline{U}$. The input vector signal $\overline{U}$ expresses an input vector $\overline{u}$ (t) for each sampling time t that contains the values of the input signal X at the respectively five preceding sampling times. Thus valid is:

$$\overline{u}(t)=(x(t-1), x(t-2), x(t-3), x(t-4), x(t-5)), \tag{3}$$

whereby x (t) indicates the value of the input signal X at the sampling time t.

The input vectors $\bar{u}$ (t) are multiplied by a vector multiplier 64 in a matrix operation, being multiplied by the respectively current coefficient vector $\bar{w}$ (t) of the coefficient vector $\bar{W}$ in order to obtain the (scalar) output values y(t) of the output signal Y at the clock time t. Thus valid in formal notation is:

$$y(t)=\bar{w}(t)\cdot\bar{u}^T(t), \tag{4}$$

whereby $__^T$ represents the transposition operator. In other words, the LMS filter 52, which can be classified as a FIR filter (FIR=finite impulse response) with five coefficients, that is shown in FIG. 3 forms a linear combination as an output value y(t) from the values of the input signal X for the last five sampling times weighted with the coefficients k0(t)–k4(t):

$$y(t)=k0(t)*x(t-1)+k1(t)*x(t-2)+k2(t)*x(t-3)+k3(t)*x(t-4)+k4(t)*x(t-5). \tag{5}$$

An element squaring unit 66 generates the element-by-element square of the signal vectors $\bar{u}$ (t), and an element summing unit 68 serves for summing up the squared elements. A small positive constant C (order of magnitude $10^{-10}$) is added to the sum obtained in this way using an adder 70, this constant C being supplied from a constant generator 72. The result is present as a (scalar) divisor at a scalar divider 74. The dividend is the scalar product from the current error value e(t) of the error signal E and an output vector of a scalar multiplier 76. This output vector arises by scalar multiplication of the input vector $\bar{u}$ (t) by a adaptation constant $\mu$.

The resulting vector of the scalar divider 74 is added to the current coefficient vector $\bar{w}$ (t) by a vector adder 78. A delay element 80 only outputs the result one clock time later, outputting this as adapted coefficient vector $\bar{w}$ (t+1) of the coefficient vector signal $\bar{W}$. One thus obtains the following overall:

$$\bar{w}(t+1)=\bar{w}(t)+(\mu*e(t)*\bar{u}(t)/©+\text{fheight}\bar{u}(t)\cdot\bar{u}^T(t))) \tag{6}$$

The circuit shown in FIG. 3 implements a LMS algorithm that approaches (adapts) the filter coefficients k0(t)–k4(t) on the basis of a stochastic gradient method such that the error signal E is largely minimized insofar as possible. An exact explanation of this algorithm may be found in Chapter 9 (Pages 365 through 372) of the book "Adaptive Filter Theory" by Simon Haykin, 3rd Edition, Prentice-Hall, 1996, the content thereof being incorporated herein by reference.

During operation of the hearing aid, as already mentioned, the first microphone 12 is situated approximately 1.6 cm in front of the second microphone 12' in the line of sight of the hearing aid user. Given a sampling frequency of 20 kHz assumed in the exemplary embodiment described here, this approximately corresponds to the distance that sound traverses in a sampling period (50 $\mu$s). In alternative embodiments, other sampling frequencies and, correspondingly, other spacings are provided or the theoretically optimum spacings are not exactly adhered to. Relatively good results have also been achieved in experiments in deviations of up to 25%.

A signal S0 from a sound source that is located in the line of sight (angle of 0°) of the hearing aid user will arrive at the front microphone 12 at the sampling time t and will arrive at the back microphone 12' at the sampling time t+1 due to the microphone spacing. Given a signal S2 from a noise source that is located behind the hearing aid user (angle of 180°), the conditions are opposite. A signal S1 from a side noise source (angle of 90°) arrives approximately simultaneously at both microphones 12, 12' and therefore also acts simultaneously on the microphone signals MIC1, MIC2. The following is valid overall:

$$mic(t)=s0(t-1)+s1(t)+s2(t), \tag{8}$$

In the above equations, mic1 (t) indicates the value of the signal MIC1 at the sampling time t. The analogous case also applies to the signals MIC2, S0, S1, S2.

By introducing equation (8) into Equation (1), the following is obtained:

$$e(t)=s0(t-4)+s1(t-3)+s2(t-3)-y(t), \tag{9}$$

and further insertion of Equation (5) into Equation(9) yields:

$$e(t)=s0(t-4)+s1(t-3)+s2(t-3)-(k0(t)*x(t-1)+k1(t)*x(t-1)+k2(t)*x(t-3)+k3(t)*x(t-4)+k4(t)*x(t-5)) \tag{10}$$

Since, as can be seen from FIG. 2, x (t)=mic1 (t) is valid of all sampling times t, the following is ultimately obtained from Equation (10) by introducing Equation (7) five times:

$$\begin{aligned}
&e(t)=s0(t-4)+s1(t-3)+s2(t-3)-\\
&(k0(t)*(s0(t-1)+s1(t-1)+s2(t-2))+\\
&k1(t)*(s0(t-2)+s1(t-2)+s2(t-3))+\\
&k2(t)*(s0(t-3)+s1(t-3)+s2(t-4))+\\
&k3(t)*(s0(t-4)+s1(t-4)+s2(t-5))+\\
&k4(t)*(s0(t-5)+s1(t-5)+s2(t-6))).
\end{aligned} \tag{11}$$

The value e(t) is minimized by the algorithm of the LMS filter 52. In this minimization event, k3(t), whose term only comprises the summand s0(t–4), increases with increasing intensity of the signal S0 (angle of 0°). Correspondingly, the amount of the filter coefficient k2(t) is an indicator for the part of the signal S1(90° angle) in the microphone signals (MIC1, MIC2, and the amount of the filter coefficients k1(t) indicates the signal part of S2 (180° angle). The values of all other filter coefficients strive toward zero.

When, for example, only signals from 0° and from 90° relative to the line of sight of the hearing aid user arrive, s2(t)=0 applies to all sampling times t. The following thus derives from Equation (11):

$$\begin{aligned}
&e(t)=s0(t-4)+s1(t-3)-\\
&(k0(t)*(s0(t-1)+s1(t-1))+\\
&k1(t)*(s0(t-2)+s1(t-2))+\\
&k2(t)*(s0(t-3)+s1(t-3))+\\
&k3(t)*(s0(t-4)+s1(t-4))+\\
&k4(t)*(s0(t-5)+s1(t-5)))
\end{aligned} \tag{12}$$

It is to be expected in this case that, as a result of the adaptation, the coefficients k2(t) (corresponding to the parts s1(t–3)) and k3(t) (corresponding to the part s0 (k–4)) increase, whereas the other coefficients strive toward zero. Given signals from 0° and 180°, a relatively high level of the coefficient signals K1, K3 derives for corresponding reasons and a low level of the coefficient signal K2 derives. The following table summarizes the results for different auditory situations:

| Signal parts from . . . | K1 | K2 | K3 | G1 | G2 | G3 |
|---|---|---|---|---|---|---|
| 0° | low | low | high | low | low | high |
| 90° | low | high | low | low | high | low |
| 180° | high | low | low | high | low | low |
| 0° and 90° | low | high | high | low | high | high |
| 0° and 180° | high | low | high | high | low | high |

As can likewise be seen from the Table, the weighting signals G1, G2, G3 always correspond to the coefficient signals K1, K2, K3. The only difference is that the weighting signals G1, G2, G3 have been normed onto a desired sum (for example, G1+G2+G3=1) by the normalization unit 60, whereby the normalization factors enter into the overall weighting signal GG. Further, differences of the weighting signals G1, G2, G3 could be increased ("spread"). In alternative embodiments, in contrast, the coefficient signals K1, K2, K3 serve directly as weighting factors. The normalization unit 60 and the weighting amplifier 50 can then be omitted.

A high weighting factor G1 results in the second noise-reduced signal R2, wherein a noise signal part from 180° has been largely reduced, contributing a large part in the output signal OUT. Overall, thus, the signal analysis unit determines the intensities or strengths of signal parts of the microphone signals MIC1, MIC2 in the angular ranges in the line of sight of the hearing aid user, transversely relative to the line of sight and behind the hearing aid user. The weighting factors G1, G2, G3 correspond to the identified intensity values. Dependent on these values, either signals from 90° or, respectively, 180° are classified as noise signals and are largely suppressed or the first microphone signal MIC1 is "through-connected" when the directional analysis has found that noteworthy (noise) signal parts are not present either from 90° or from 180°.

Figure 4:
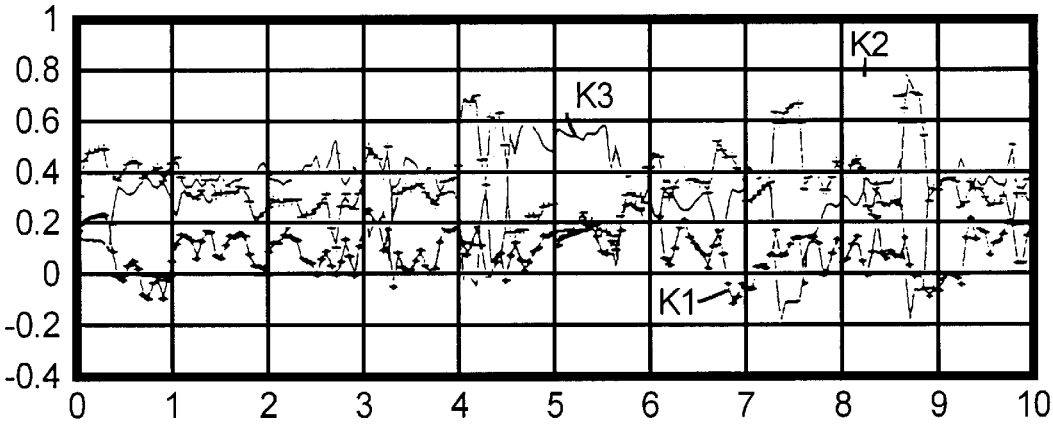
FIG. 4 is a diagram showing the coefficient signals relative to time in accordance with the invention.

FIG. 4 shows the time curve of the coefficient signals K1 (line -*-*-), K2 (Line -+-+-), and K3 (Line ----------) in a realistic experiment having a useful signal source from 0° and a noise signal source from 90°(each irrespective voice signal). The abscissa axis represents the range from 0 through 10 seconds. The value of the coefficient signal K2 (90° indicator) is, as anticipated, always critically higher then the value of the coefficient signal K1 (180° indicator).

Figure 5:
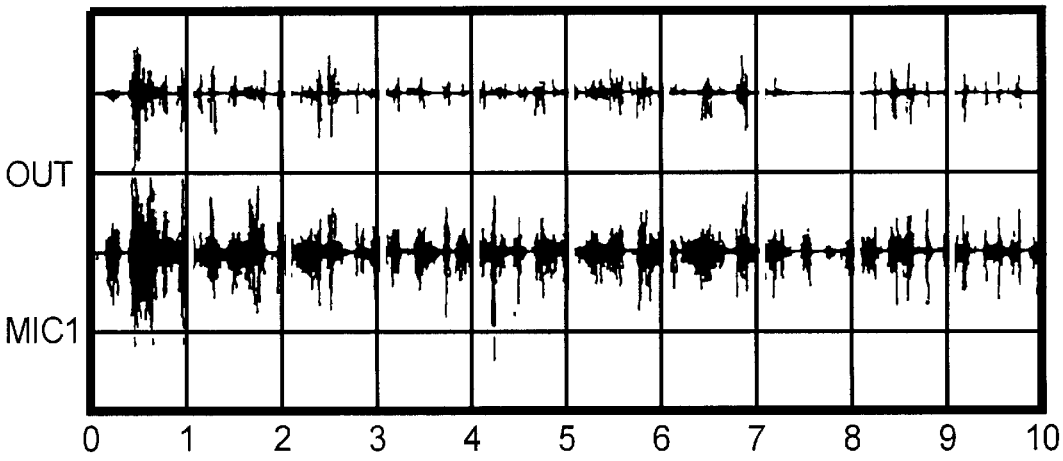
FIG. 5 is a diagram showing a microphone signal and an output signal in accordance with the invention.

The first microphone signal MIC1 and the output signal OUT for the signal example employed in this experiment are shown in FIG. 5. The microphone signal MIC1 contains mainly noise signal parts particularly in the time span between 7.3 and 8.1 seconds. It can be seen that these parts are largely suppressed in the output signal OUT.

The functioning of the inventive hearing aid and method have been described on the basis of the circuit shown as an example in FIGS. 1 through 3, but other implementations are possible in alternative embodiments. In particular, the functions of the circuit can be entirely or partly realized by program modules of a digital processor, for example of a digital signal processor. The circuit, further, can be constructed as a digital or as an analog circuit or in different mixed forms between these two extremes.

In further alternative embodiments, the result of the direction analysis is interpreted in some other way for signal processing. For example, the coefficient signals K1, K2, K3 could also be employed for the time-variant drive of, for example, three permanently prescribed directional microphone characteristics having poles at 90°, 135° and 180°.

Further, modified embodiments are provided wherein an "intelligent" determination of noise and wanted signal parts is undertaken (for instance with the norming unit 60). Whereas the signal part in line of sight direction (0°) was always considered as the wanted signal part in the above-described exemplary embodiment, the signal S1 given, for example, the presence of the signal S1 from 90° at simultaneous non-presence of the signal S0 from 0°, can then be viewed as wanted signal and no longer be suppressed.

What is claimed is:

1. A hearing aid comprising:

a microphone unit having at least two microphones, each emitting a microphone signal so that said microphone unit emits at least two microphone signals, said microphone unit having a directional characteristic associated therewith and each of said microphone signals having signal components with respective intensities;

a signal processing unit supplied with said microphone signals which performs a directionally dependent processing action on said microphone signals to amplify or attenuate said components of said microphone signals, said directionally dependent processing action being selected from the group consisting of modifying the directional characteristic of the microphone unit, differently filtering said microphone signals, and selecting a noise elimination technique for eliminating noise from said microphone signals;

a directional analysis unit also supplied with said microphone signals for performing a directional analysis of said microphone signals by identifying said respective intensities of said signal components, to generate a directional analysis result;

said signal processing unit being supplied with said directional analysis result and modifying said processing action dependent on said directional analysis result to generate a processing unit output signal; and a reproduction unit supplied with said processing unit output signal for converting said processing unit output signal into an audio signal and for emitting said audio signal.

2. A hearing aid as claimed in claim 1 wherein said signal analysis unit identifies said intensities of said components of said microphone signals in a plurality of directional classes to produce said directional analysis result.

3. A hearing aid as claimed in claim 1 wherein said signal analysis unit comprises an adaptive filter having filter coefficients which are modifiable to produce said directional analysis result.

4. A hearing aid as claimed in claim 3 wherein said signal analysis unit is an LMS filter.

5. A hearing aid as claimed in claim 1 wherein said signal processing unit comprises at least one reduction unit which determines a noise reduced signal from said microphone signals wherein signal components of said microphone signals in a predetermined direction are attenuated.

6. A hearing aid as claimed in claim 5 wherein said signal processing unit further comprises a mixing unit for weighting said noise-reduced signal and at least one of said microphone signals dependent on respective weighting factors which are respectively set by said directional analysis result, said mixing unit mixing said weighted signal with said noise-reduced signal to produce said processing unit output signal.

7. A hearing aid as claimed in claim 1 wherein said microphone unit comprises two microphones spaced at most 5 cm from each other.

8. A hearing aid as claimed in claim 1 wherein said microphone unit comprises two microphones spaced at most 2.5 cm from each other.

9. A method for processing microphone signals in a hearing aid comprising the steps of:

detecting incoming audio signals in a microphone unit having a plurality of microphones and respectively emitting microphone signals from said plurality of microphones, each of said microphone signals having signal components with respective intensities, and said microphone unit having a directional characteristic associated therewith;

conducting a directional analysis of said microphone signals by identifying said respective intensities of said signal components of the respective microphone signals, to produce a directional analysis result;

processing said microphone signals by performing a processing action on said microphone signals, resulting in directionally dependent amplification or attenuation of said microphone signals to generate a processed signal;

performing said processing action dependent on said directional analysis result and selecting said processing action from the group consisting of modifying the directional characteristic of the microphone unit, differently filtering said microphone signals, and selecting a noise elimination technique for eliminating noise from said microphone signals; and converting said processed signal into an audio output signal and emitting said audio output signal.

10. A method as claimed in claim 9 comprising performing said directional analysis of said microphone signals by identifying the respective intensities of said signal components of the respective microphone signals in a plurality of directional classes.

11. A method as claimed in claim 9 comprising performing said directional analysis of said microphone signals by adaptively filtering said microphone signals in an adaptive filter having filter coefficients which are modified to produce said directional analysis result.

12. A method as claimed in claim 11 comprising filtering said microphone signals in an LMS filter.

13. A method as claimed in claim 9 wherein the step of processing said microphone signals includes determining at least one noise-reduced signal wherein signal components of at least one of said microphone signals are attenuated in a predetermined direction dependent on said directional analysis result.

14. A method as claimed in claim 13 comprising the additional step of weighting said noise-reduced signal and at least one of said microphone signals in a mixing unit dependent on said directional analysis result to produced said processed signal.

* * * * *